United States Patent [19]

Amrich et al.

[11] Patent Number: 5,028,159

[45] Date of Patent: Jul. 2, 1991

[54] LOOSELEAF BINDER

[75] Inventors: Robert C. Amrich, Glastonbury, Conn.; Vytautas K. Beleckis, E. Longmeadow, Mass.

[73] Assignee: Dennison Manufacturing Company, Framingham, Mass.

[21] Appl. No.: 493,924

[22] Filed: Mar. 15, 1990

[51] Int. Cl.[5] ..... B42F 13/02

[52] U.S. Cl. ..... 402/20; 402/19; 402/39; 402/44

[58] Field of Search ..... 402/20, 19, 46, 44, 402/39, 80 P

[56] References Cited

U.S. PATENT DOCUMENTS

| | | | |
|---|---|---|---|
| 2,071,768 | 2/1937 | Schade | 402/44 |
| 2,178,767 | 11/1939 | Unger et al. | 402/39 |
| 2,223,030 | 11/1940 | Edler et al. | 402/20 |
| 2,363,848 | 11/1944 | Emmer | 402/20 |
| 2,399,561 | 4/1946 | Murphy | 402/20 |
| 2,664,897 | 1/1954 | Derringer | 402/39 |
| 3,827,111 | 8/1974 | O'Connell | 402/20 |
| 4,582,442 | 4/1986 | Rager | 402/80 P |
| 4,607,970 | 8/1986 | Heusinkveld | 402/19 |

*Primary Examiner*—Douglas D. Watts
*Assistant Examiner*—Hwei-Siu Payer
*Attorney, Agent, or Firm*—Arthur B. Moore

[57] ABSTRACT

An economical lightweight looseleaf binder combines the functionality of a standard ring binder with easy-to-use characteristics of report covers. The cover is folded to define front and back panels as well as a spine portion, and additionally includes a crease at the longitudinal center line of the two ring assemblies which are both secured to the back panel. The ring assemblies include a series of hooks having complementary notched profiles which firmly engage one another when closed, yet may be easily disengaged through flexure of the cover. In one construction, the binder comprises a pressboard cover to which is attached a pair of plastic ring assemblies. The hooks are configured to permit filler sheets to lie flat and to facilitate transfer of sheets from one side to the other.

20 Claims, 6 Drawing Sheets

LOOSELEAF BINDER

SPECIFICATION

The present patent application relates to looseleaf binders, and more particularly to lightweight, low cost ring binders.

Ring binders are customarily thought of as articles for sturdy, secure housing of documents. Although a wide variety of ring binder constructions are known, characteristically they incorporate a series of metal rings together with a mechanism for opening the rings to permit insertion of filler sheets, then closing the rings to securely engage the documents. The present invention relates to a ring binder which functions much in the traditional manner, yet is of an economical, easy-to-use design owing to its lightweight construction and novel ring mechanism.

It is known in the prior art, U.S. Pat. No. 2,71,768 Schade, to provide a looseleaf binder which has a series of rings or prongs secured to plates which are hinged together at a longitudinal center line, which plates may be manually pivoted at their hinge to open or close the binder. The looseleaf book of Schade, however, is of a heavy-duty construction, including, for example, metallic hinge plates 2, 3. Unlike the design of the present binder, the Schade plates are located at the back of the binder and in fact form the back panel of the binder. The prongs 8, 9 are of a semi-circular design, and are not profiled so as to snap into and out of engagement with each other but rather, overlap each other when closed.

It is a principal object of the invention to provide an economical lightweight ring binder.

Such ring binder should be easy to use. Its design should facilitate the opening and closing of the binder rings for insertion or removal of documents. The binder should also permit inserted sheets to lie flat, and inserted pages to be turned easily by the user.

SUMMARY OF THE INVENTION

In achieving the above and additional objects the invention provides a looseleaf binder which comprises a cover of flexible material which is folded to define front and back panels and a spine portion, said cover being foldable along a flexure axis at the back panel. The looseleaf binder further includes first and second hook assemblies which are secured to the back panel at either side of the flexure axis, each such assembly including a support member integral with a plurality of hooks all having notched engagement portions. Respective hooks of the first and second hook assemblies may be brought together and securely joined at their notched engagement portions to form binder rings for filler sheets, and the binder may be flexed along the flexure axis to separate the hooks and permit removal of filler sheets.

In a preferred, economical construction of the invention, the cover is comprised of a cardboard or pressboard material, and the first and second hook assemblies are comprised of a sturdy plastic material. The hook assemblies may be secured to the cover by inserting studs formed in the former assemblies through apertures in the cover's back panel, then subjecting the studs to heat or ultrasonic energy to weld the studs in place. Alternatively, the hook assemblies may be adhesively secured or riveted to the back cover.

Advantageously, the notched engagement portion of each of the hooks is defined by a hollow, and a boss which is complementary to the hollow, whereby respective hooks are engaged by press fitting the boss of one hook into the hollow of the mating hook. Each boss of a hook may include first and second engagement surfaces, wherein bosses of respective hooks slide along their respective first engagement surface during separation of hook assemblies, and along their second engagement surfaces during the joining of the hooks. The first engagement surface may provide a camming action which laterally separates the hooks when they are subjected to longitudinal separating forces. The second engagement surfaces may be oriented to gradually bring a pair of hooks into engagement.

The binder ring assemblies of the preferred binder construction incorporates interlocking hooks. In an alternative embodiment, the hooks have engagement portions which are configured to overlap but not interlock when the hooks are closed.

BRIEF DESCRIPTION OF THE DRAWINGS

The above and additional aspects of the invention are illustrated in the following detailed description of the preferred embodiment, together with the drawings in which.

DETAILED DESCRIPTION

Figures 1, 1A:
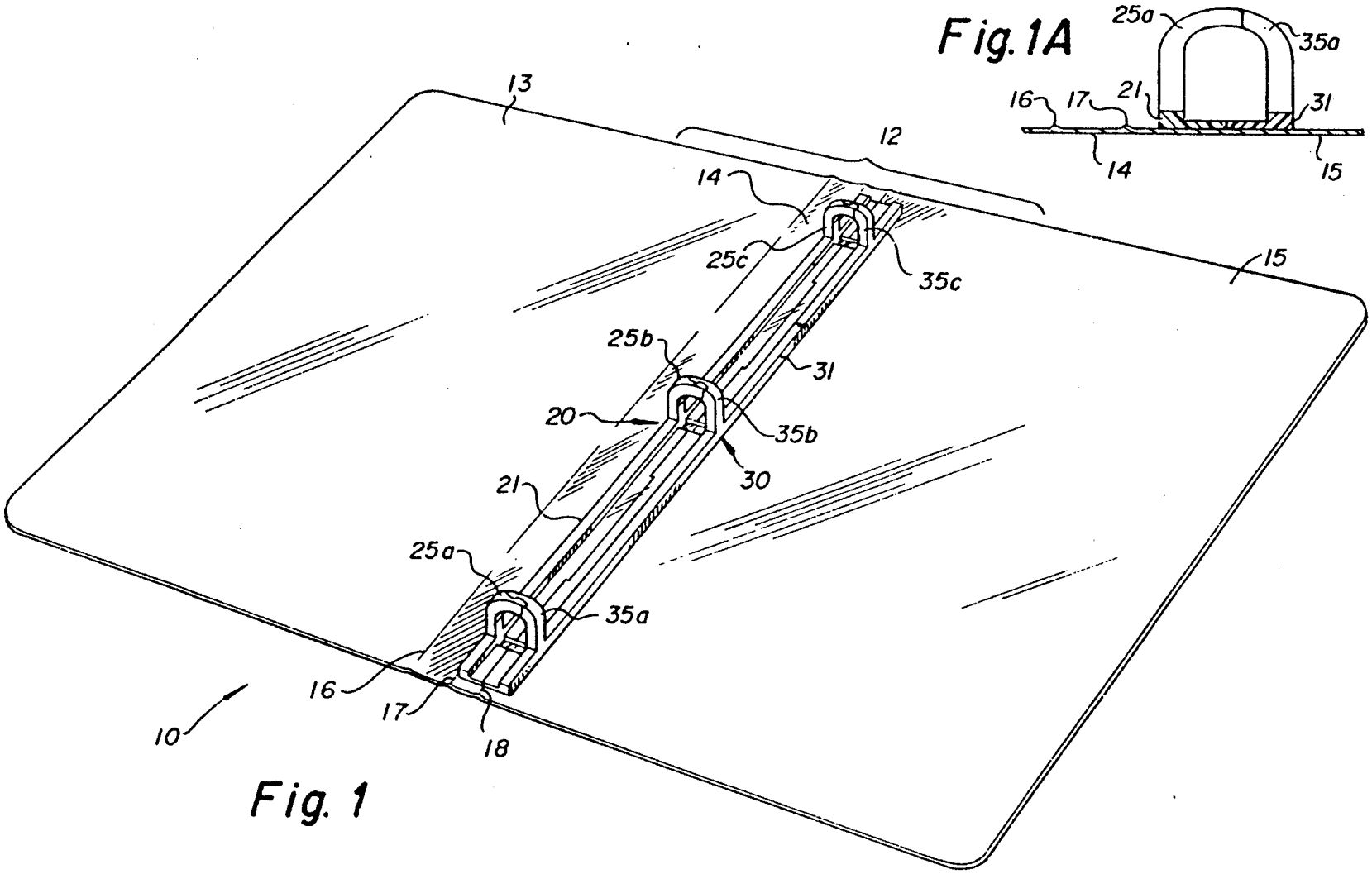
FIG. 1 is a perspective view of a three ring binder in accordance with the preferred embodiment of the invention, with its hooks closed.
FIG. 1A is a partial side view of the binder of FIG. 1 showing in its closed hooks.

FIGS. 1–8 illustrate a low cost three ring binder in accordance with a preferred embodiment of the invention. As seen in the perspective view of FIG. 1, the binder includes a cover 12 (here lying flat) and a ring mechanism consisting of left and right hand ring assemblies 20, 30 respectively. The ring assemblies 20, 30 each consist of a plate (21, 31) carrying a series of hooks (25, 35). The cover 12 is creased or hinged at 16 and 17 (See also FIG. 4) to define a front panel 13 and rear panel 15 as well as a spine portion 14. In addition, the cover is creased or hinged at 18 at a longitudinal center line of the ring assemblies 20, 30, both of which are secured to rear panel 15. Crease or hinge 18 permits the flexure of rear panel 15 to open and close the hooks 25*a–c*, 35*a–c* of the ring assemblies 20, 30. Note that since both of the ring assemblies 20 and 30 are located on the back cover 15, filler sheets will lie flat whether or not the front cover 13 is folded over the back cover 15. See also FIG. 1A, which shows that the hooks 25*a*, 35*a* form a generally inverted U-shaped configuration when they are closed. This configuration allows inserted sheets on either side of the cover to lie flat, and to be easily transferred from one set of hooks to the other.

Figures 2, 2A:
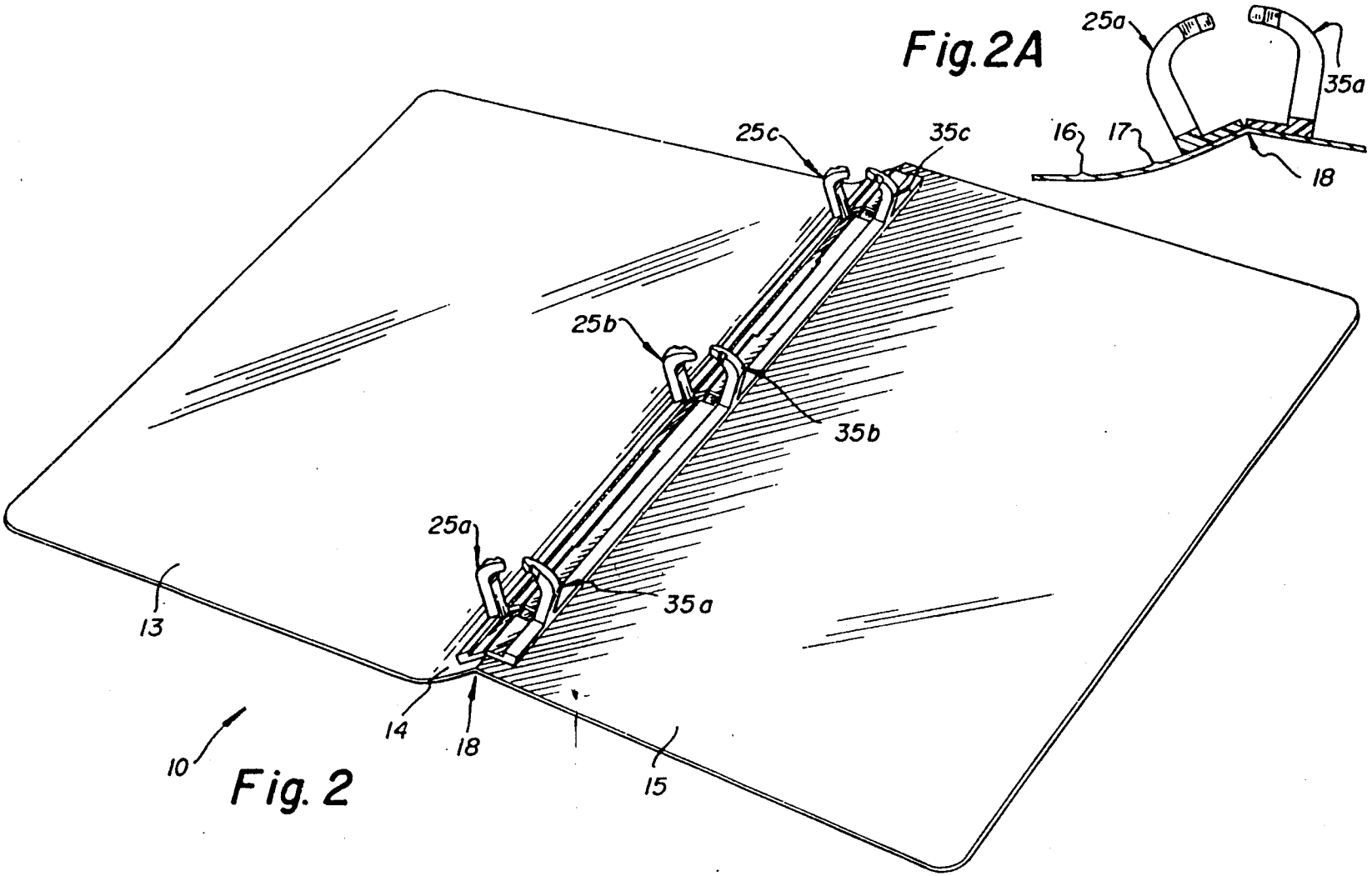
FIG. 2 is a perspective view of the binder of FIG. 1 with its cover flexed to open the hooks.
FIG. 2A is a partial side view of the binder of FIG. 2 showing its opened hooks.
Figure 3:
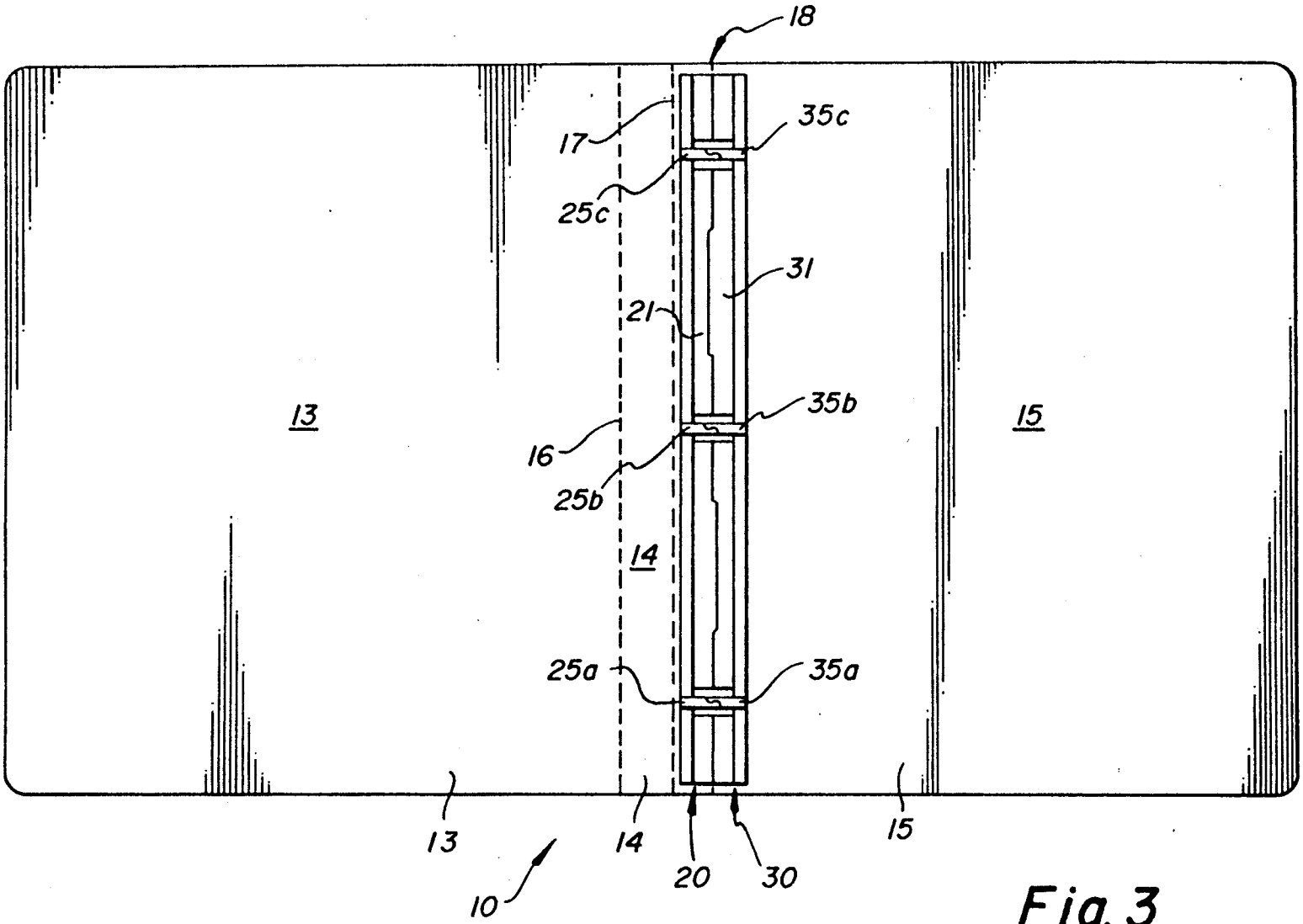
FIG. 3 is a top view of the binder of FIG. 1 with the cover flat and hooks closed.

FIG. 2 shows the flexure of the binder cover 12 to open the hooks 25*a–c* 35*a–c*. As seen in FIGS. 2, 2A, the cover is flexed at the crease or hinge 18 in order to cause the separation of the hooks.

The ring binder of the invention may be conveniently manufactured from low cost, lightweight materials. In one construction, the cover consisted of coated pressboard, and the ring assemblies 20, 30 were molded from a synthetic material such as high impact styrene. The cover blank 12 as seen in a top view of FIG. 4 was cut creased at 16, 17, and 18 and punched with apertures 11*a–c*, 19*a–c* which are used to secure the ring assemblies 20, 30. Ring assemblies 20, 30 were molded in identical configurations, i.e. the assemblies 20, 30 are indistinguishable when the hooks are aligned in the same direction. This feature lowers the cost of manufacture. When ring assemblies 20, 30 are mounted in the binders with the rings facing each other, the rings form a complementary (mating) profile. Ring assemblies 20, 30 each included a series of studs (22*a–*22*c*, 32*a–*32*c*) which are inserted in the cover blank apertures 11*a–c*, 19*a–c* and staked to the cover using heat, hot air or ultrasonic welding.

Figure 4:
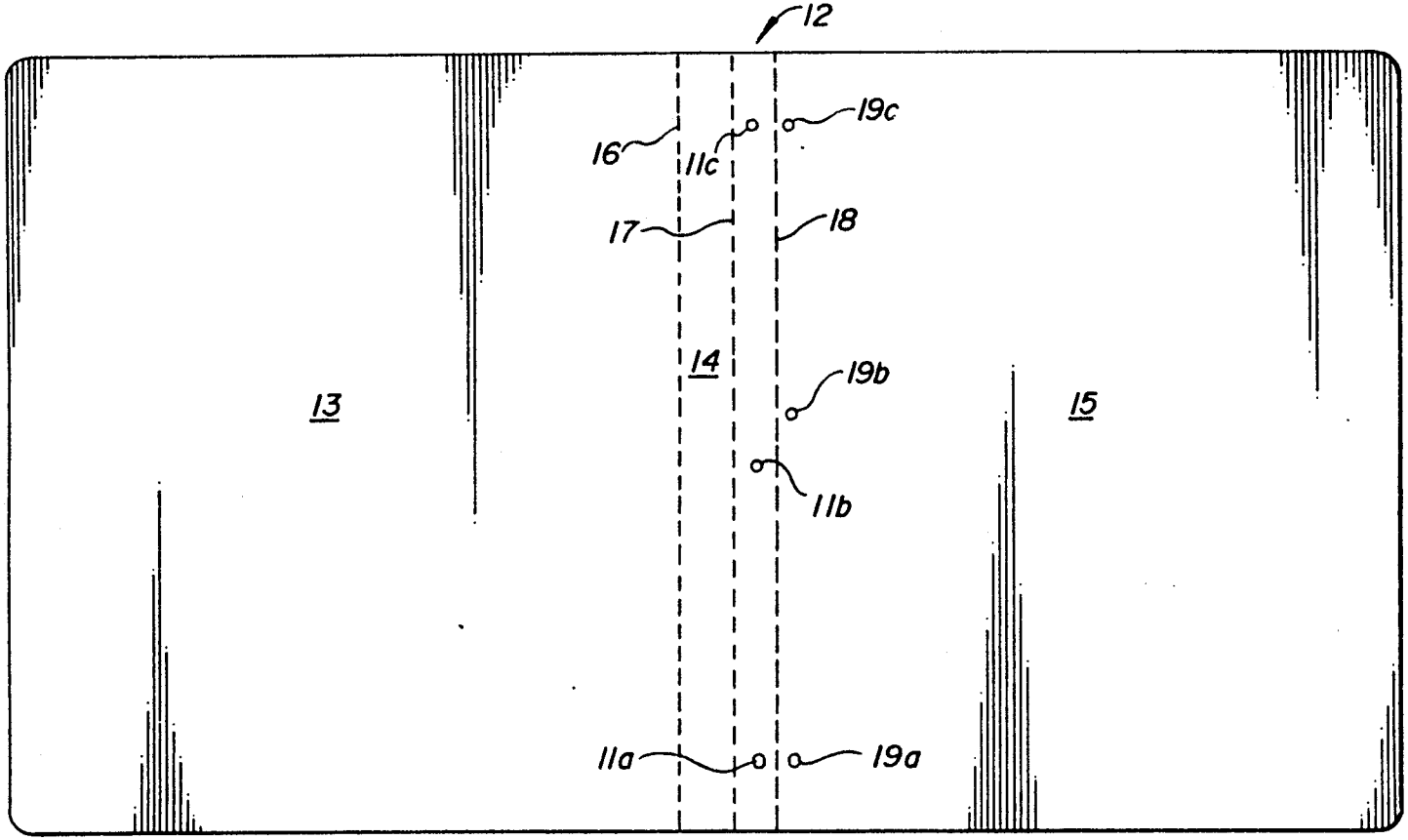
FIG. 4 is a top view of the cover blank for the binder of FIG. 1.
Figure 5:
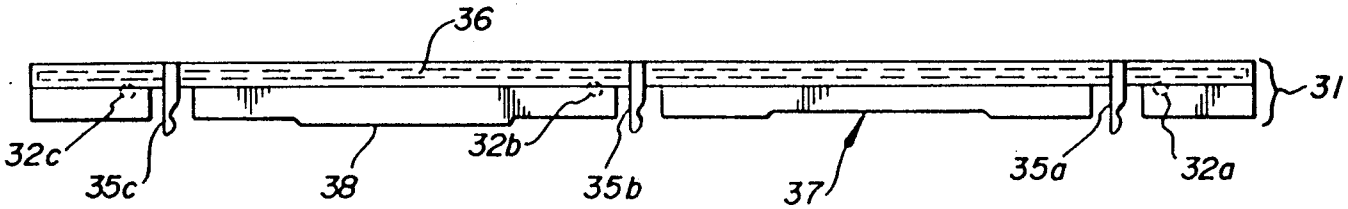
FIG. 5 is a top view of the right hand hook assembly from FIG. 1.
Figure 6:
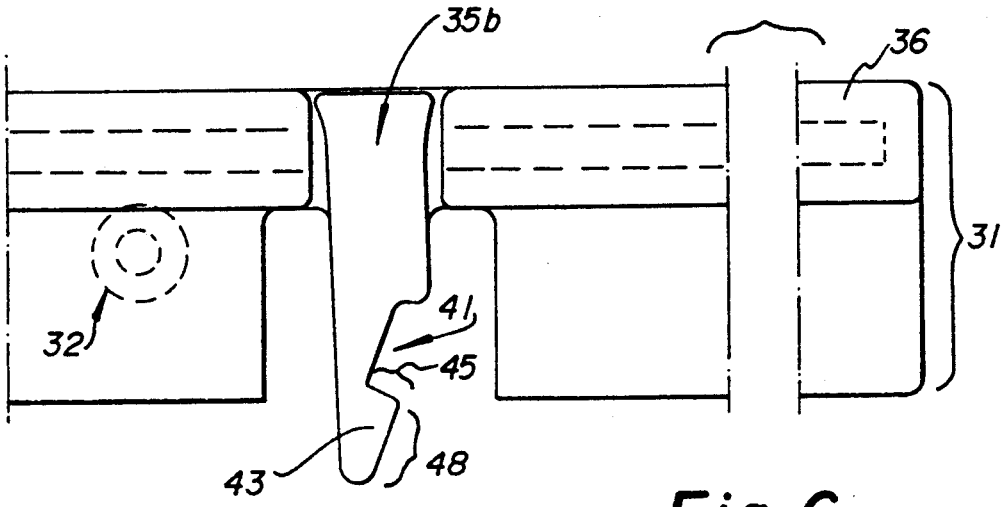
FIG. 6 is a detail view from the top view of FIG. 5, showing the middle hook and surrounding features.
Figure 8:
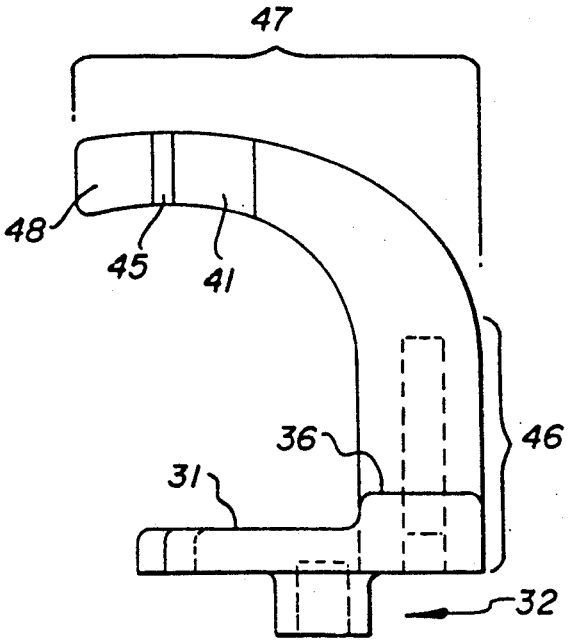
FIG. 8 is a right side view of the hook of FIG. 6.

FIG. 4 shows the ring assembly 30 in a top view. As seen in FIGS. 1, 5, the plate 31 of ring assembly 30 includes a ledge 36 which supports the hooks 35*a–*35*c*. One edge of ring assembly 30 is indented in a profile complementary to that of the mating edge of ring assembly 20, including an indentation 37 and ridge 38. As seen in the detail view of FIG. 6, the hook 35*b* has a notched profile; as noted above this profile is complementary to that of a mating surface of hook 25*b* (see FIG. 3). As seen in FIGS. 6 and 8, hook 35*b* includes a notch 41 and a complementary boss 43. Boss 43 includes a sharply inclined engagement surface 45 as well as a more gradually inclined surface 48. When the user closes a pair of hooks, the surface 48 of each hook slides against a like surface of the opposite hook until the bosses of the hooks snap into the notches of these hooks. When a longitudinal separating force is exerted on the hook assemblies the sharply inclined surface 45 of each hook slides against a complementary surface of the opposite hook thereby laterally separating the respective hooks until they break free from one another. In one embodiment, the surface 48 forms an angle of 45 degrees with the opposite edge of hook 35*b*, while the surfaces 45, 48 form a mutual angle of slightly greater than 90 degrees.

This notched configuration permits the convenient opening and closing of the ring binder mechanism. When the hooks are closed the user may simply grasp the binder at both hook plates and flex the cover around the hinge or crease 18 to separate the hooks. The hooks may be snapped together easily by individually moving them toward each other.

Figure 7:
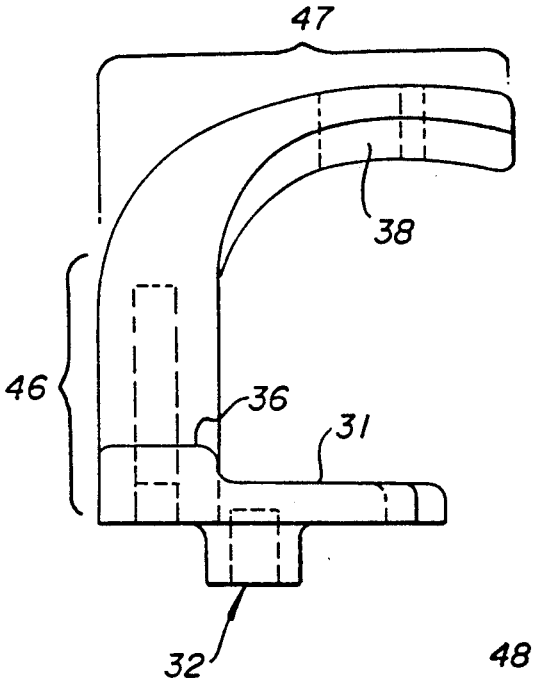
FIG. 7 is a left side view of the hook of FIG. 6.

FIGS. 7, 8 are side views of the left and right sides of the hook 35*b* of FIG. 6, showing in detail an advantageous configuration of a given hook. The hook includes a vertical portion 46 which retain filler sheets in a stack, and a curved portion 47. The left side of the hook is tapered at 38 (FIG. 7) while the right side has the notched configuration discussed above.

Figure 9:
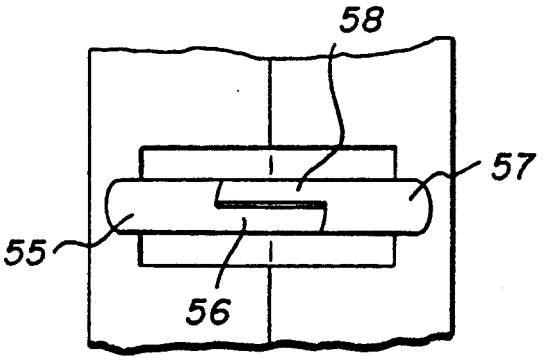
FIG. 9 is a top view of a pair of closed hooks in accordance with an alternative embodiment of the invention.
Figure 10:
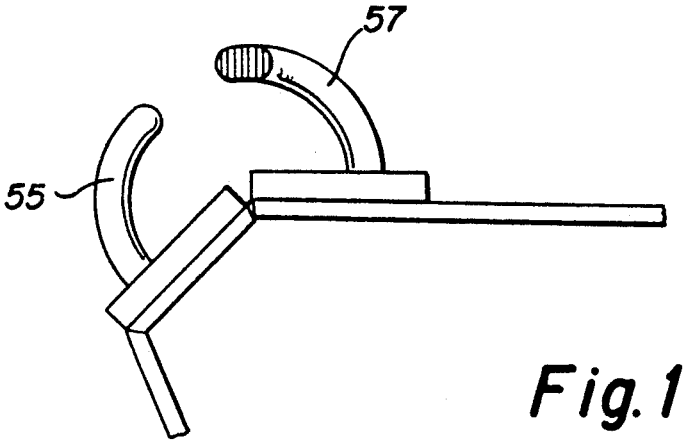
FIG. 10 is a partial side view of a binder incorporating the hooks of FIG. 9, with the covers folded back.
Figure 11:
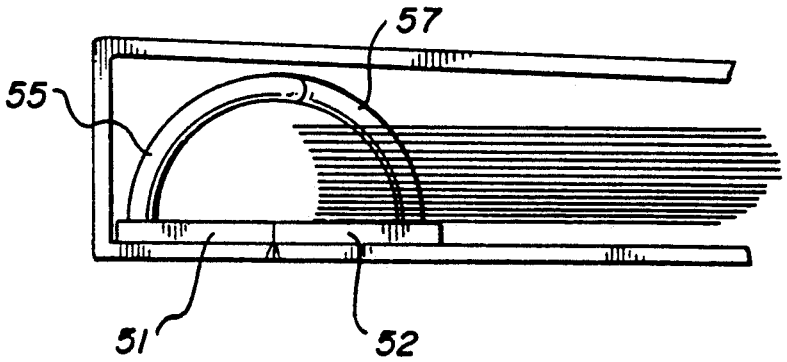
FIG. 11 is a partial side view of the binder of FIG. 10, with the covers closed.

The ring construction of the preferred binder design discussed above incorporates interlocking hooks. In an alternative construction, shown in the top view of FIG. 9 and the side views of FIG. 10 (covers folded back) and 11 (covers closed), the hooks 55, 57 do not interlock, but include engagement portions 456, 58 which overlap when the rings are completely closed. The hook plates 51, 52 are secured to the cover using an adhesive.

We claim:

1. A looseleaf binder comprising:

a cover formed of flexible material consisting of front and back panels and a spine portion, therebetween said cover being foldable along a flexure axis at said back panel; and first and second hook assemblies being secured to said back panel at either side of said flexure axis, each of said hook assemblies having a support member integral with a plurality of hooks all having notched engagement portions, each of said notched engagement portions having a boss defining a hollow which is substantially complementary in shape to the boss of a mating hook, each such boss having first and second engagement surfaces, wherein the bosses of mating hooks slide along their respective first engagement surfaces while separating said hooks to offer a limited resistance to separation, and slide along the second engagement surfaces while joining said hooks.

2. A looseleaf binder as defined in claim 1, wherein the cover is comprised of flexible cardboard.

3. A looseleaf binder as defined in claim 1, wherein the hook assemblies are comprised of a sturdy molded plastic material.

4. A looseleaf binder as defined in claim 1, wherein each support member comprises a plate having a plurality of studs which are secured through holes in said cover.

5. A looseleaf binder as defined in claim 1, wherein each support member comprises a plate which is adhesively secured to said back panel.

6. A looseleaf binder as defined in claim 1, wherein the first and second hook assemblies are identical in appearance when facing in the same direction.

7. A looseleaf binder as defined in claim 1, wherein the cover of flexible material comprises an integral sheet creased to define the front and back panels and spine portion.

8. A looseleaf binder as defined in claim 1, wherein the front and back panels and spine portion are separate pieces joined by hinges.

9. A looseleaf binder as defined in claim 1, wherein the first engagement surfaces of joined hooks are inclined relative to a longitudinal axis of the hooks to provide a camming action which laterally separates the hooks when they are subject to a longitudinal separating force.

10. A looseleaf binder as defined in claim 1, wherein the second engagement surfaces are inclined relative to said longitudinal axis of the hooks to gradually bring the opposing hooks into interlocking engagement as said hooks move toward each other.

11. A looseleaf binder comprising:

a cover formed of flexible material consisting of front and back panels and a spine portion, therebetween said cover being foldable along a flexure axis at said back panel; and first and second hook assemblies being said back panel at either side of said flexure axis, each of said hook assemblies having a support member integral with a plurality of hooks all having notched engagement portions, each of said notched engagement portions having a boss defining a hollow which is substantially complementary in shape to the boss of a mating hook, wherein respective hooks of said first and second hook assemblies may be brought together so that the boss of each hook interlocks with the hollow of the mating hook in order to resist the separation of the hooks, and wherein the binder may be flexed around said flexure axis to separate said hooks and permit removal of filler sheets.

12. A looseleaf binder as defined in claim 11, wherein the cover is comprised of flexible cardboard.

13. A looseleaf binder as defined in claim 11, wherein the hook assemblies are comprised of a sturdy molded plastic material.

14. A looseleaf binder as defined in claim 11, wherein each support member comprises a plate having a plurality of studs which are secured through holes in said cover.

15. A looseleaf binder as defined in claim 11, wherein the first and second hook assemblies are identical in appearance when facing in the same direction.

16. A looseleaf binder as defined in clam 11 wherein the cover of flexible material comprises an integral sheet creased to define the front and back panels and spine portion.

17. A looseleaf binder as defined in claim 11, wherein the front and back panels and spine portion are separate pieces joined by hinges.

18. A looseleaf binder as defined in claim 11, wherein the boss includes first and second engagement surfaces, wherein bosses of mating hooks slide along their respective first engagement surfaces while separating the hooks, and along the second engagement surfaces while joining the hooks.

19. A looseleaf binder as defined in claim 15, wherein the first engagement surfaces of interlocked hooks are inclined relative to a longitudinal axis of the hooks to provide a camming action which laterally separates the hooks when they are subject to a longitudinal separating force.

20. A looseleaf binder as defined in claim 18, wherein the second engagement surfaces are inclined relative to a longitudinal axis of the hooks to gradually bring opposing hooks into interlocking engagement as said hooks move toward each other.

* * * * *